US005579887A

United States Patent [19]

Leibu et al.

[11] Patent Number: 5,579,887

[45] Date of Patent: Dec. 3, 1996

[54] COIN DETECTION APPARATUS

[75] Inventors: Mark H. Leibu, St. Louis; Thierry J. Vivet, Maryland Heights, both of Mo.

[73] Assignee: Coin Acceptors, Inc., St. Louis, Mo.

[21] Appl. No.: 490,637

[22] Filed: Jun. 15, 1995

[51] Int. Cl.[6] ..... G07D 5/08; H01F 27/24; H01F 27/28; H01F 41/06

[52] U.S. Cl. ..... 194/317; 29/605; 336/15; 336/170; 336/183; 336/233

[58] Field of Search ..... 194/317, 318, 194/319; 336/15, 170, 182, 183, 184, 185, 188, 192, 198, 233; 29/605

[56] References Cited

U.S. PATENT DOCUMENTS

| | | | |
|---|---|---|---|
| Re. 29,019 | 10/1976 | Shtrikman | 336/170 X |
| 3,229,198 | 1/1966 | Libby . | |
| 3,314,006 | 4/1967 | Hentschel . | |
| 3,373,856 | 3/1968 | Kusters et al. . | |
| 3,401,780 | 9/1968 | Jullien-Davin . | |
| 3,599,771 | 8/1971 | Hinterstocker . | |
| 3,870,137 | 3/1975 | Fougere . | |
| 3,901,368 | 8/1975 | Klinger . | |
| 3,947,795 | 3/1976 | Donnelly et al. | 336/192 X |
| 3,952,851 | 3/1976 | Fougere et al. . | |
| 3,966,034 | 6/1976 | Heiman et al. . | |
| 4,086,527 | 4/1978 | Cadot | 324/233 |
| 4,124,111 | 11/1978 | Hayashi . | |
| 4,184,366 | 1/1980 | Butler . | |
| 4,323,148 | 4/1982 | Nichimoto et al. . | |
| 4,326,621 | 4/1982 | Davies . | |
| 4,335,604 | 6/1982 | Ekman . | |
| 4,353,453 | 10/1982 | Partin et al. . | |
| 4,361,218 | 11/1982 | Van Dort . | |
| 4,371,073 | 2/1983 | Dubey . | |
| 4,398,626 | 8/1983 | Barnes . | |
| 4,436,196 | 3/1984 | Crisp et al. . | |
| 4,448,297 | 5/1984 | Mendelsohn . | |
| 4,473,811 | 9/1984 | Schauble | 29/605 X |
| 4,488,116 | 12/1984 | Plesko | 324/236 |
| 4,742,903 | 5/1988 | Trummer | 194/317 |
| 4,809,838 | 3/1989 | Houserman | 194/317 |
| 4,842,119 | 6/1989 | Abe | 194/317 |
| 4,875,567 | 10/1989 | Fitton | 194/318 |
| 4,905,814 | 3/1990 | Parker et al. | 194/318 |
| 4,971,187 | 11/1990 | Furuya et al. | 194/318 |
| 4,995,497 | 2/1991 | Kai et al. | 194/318 |
| 4,998,610 | 3/1991 | Said et al. | 194/318 |
| 5,040,657 | 8/1991 | Gunn et al. | 194/317 |
| 5,078,252 | 1/1992 | Furuya et al. | 194/318 |
| 5,158,166 | 10/1992 | Barson | 194/319 |
| 5,191,957 | 3/1993 | Hayes | 194/318 |
| 5,199,545 | 4/1993 | Takamisawa et al. | 194/319 |
| 5,207,307 | 5/1993 | Waite | 194/317 |
| 5,263,566 | 11/1993 | Nara et al. | 194/318 |
| 5,293,979 | 3/1994 | Levasseur | 194/317 |
| 5,293,980 | 3/1994 | Parker | 194/317 |
| 5,323,891 | 6/1994 | Waite | 194/318 |
| 5,351,167 | 9/1994 | Wai et al. | 36/192 X |
| 5,353,906 | 10/1994 | Takamisawa et al. | 194/319 |

FOREIGN PATENT DOCUMENTS

| | | | |
|---|---|---|---|
| 227453 | 7/1987 | European Pat. Off. | 194/318 |

OTHER PUBLICATIONS

Standard Specifications For Ferrite Pot Cores, Magnetic Materials Producers Association, Jan. 1984.

*Primary Examiner*—F. J. Bartuska
*Attorney, Agent, or Firm*—Haverstock, Garrett & Roberts

[57] ABSTRACT

A differential type sensing unit which includes a winding core having a winding shaft is described. In one embodiment, a post extends from the winding shaft and is located intermediate first and second winding ends of the winding shaft. The post facilitates reversing the winding direction of a conductor wound on the winding shaft. The conductor is wound such that the sensing unit includes a first sensing coil and a second sensing coil formed in a series opposing configuration. The sensing unit may be integrated with a driving unit to include driving coils formed over the top of the sensing coils.

33 Claims, 3 Drawing Sheets

COIN DETECTION APPARATUS

FIELD OF THE INVENTION

This invention relates generally to vending machines and more particularly, to sensing units for use in coin detection and validation.

BACKGROUND OF THE INVENTION

Known coin detectors and validators typically include a signal driving unit and a signal sensing unit. The driving unit and the sensing unit each typically include at least one coil formed on a solid core. The driving unit and the sensing unit are placed adjacent a coin path of the coin detector and validator.

In operation, a deposited coin is routed along the coin path. As the coin passes by the driving unit, the driving coil is energized with a known alternating signal. A varying magnetic field is generated by the driving coil when the coil is energized by such an alternating signal. As the coin passes through the varying magnetic field, eddy currents are induced in the coin. The eddy currents are generally concentrated near the surface of the coin and generate magnetic fields. The characteristics of the eddy current magnetic fields are dependent upon the resistance, inductance, and permeability of the coin material as well as the coin size.

The eddy current magnetic fields of the coin and the magnetic field generated by the driving coil induce a voltage in the sensing coil. The characteristics of the induced voltage are dependent on the magnetic fields from the driving unit and coin. Since the driving signal is known, the induced signal in the sensing coil can be analyzed to determine the coin type. For example, a matching algorithm can be used to match certain characteristics of the sensing coil signal with predetermined unique characteristics for each coin type. If the sensing unit signal matches certain characteristics for a particular coin type, then the deposited coin is identified as being that particular coin type.

Other known coin detectors include an integrated sensing and driving unit. An integrated sensing and driving unit includes one core. Both the sensing coil and the driving coil are formed on the one core.

Differential type sensing units with at least two sensing coils formed on one core also have been utilized in coin detectors. In differential type sensing units, the two sensing coils are wound on one core in a series opposing configuration. That is, the turns of the first coil are wound in one direction and the turns of the second coil are wound in an opposite direction. The differential type sensing unit may also be integrated with the driving unit. Particularly, two driving coils are formed on the one core over the sensing coils and in a series adding configuration.

Although differential type sensing units provide some advantages, known differential type sensing units are expensive to manufacture. Particularly, in manufacturing known differential type sensing units, the winding operation is a time-consuming process due to the need to prevent the loosening or unwinding of the first formed sensing coil while forming the second sensing coil. Such loosening or unwinding typically occurs when the winding direction is reversed in order to form the second sensing coil.

To prevent such loosening or unwinding, after the first sensing coil is formed, a glue or other adhesive is applied to the first sensing coil and allowed to cure. After the adhesive has cured, the second sensing coil is formed on another part of the core. The cured adhesive prevents the first sensing coil from loosening or unwinding as the second sensing coil is formed. Applying the adhesive and allowing it to cure is time-consuming and costly.

Further, it is desirable to utilize small sensing units in vending applications. The costs associated with forming differential type sensing units as described above, however, prevent economical manufacture of such small differential type sensing units. Small sensing units are desirable for coin detection because such small sensing units can be positioned close to the coin path for greater magnetic coupling with the coin passing along the coin path. Greater magnetic coupling results in higher magnitude signals being induced in the sensing coils and more accurate coin type identification.

In addition to the sensing unit size being a factor with respect to placement of the sensing unit in a desired position relative to the coin path, known differential type sensing units also include leads or wires extending from both ends of the core. Such a configuration inhibits the desired placement of the sensing unit in close proximity to the coin path. Particularly, with known configurations, at least one lead from the sensing unit extends from the end of the sensing unit which is placed adjacent the coin path. The lead interferes with positioning the sensing coil close to the coin path.

Also, known sensing units are coupled to other components by, for example, soldering the sensing unit leads to the leads of the other components. Soldering such leads together increases the assembly time and cost associated with such sensing units.

Accordingly, it is desirable and advantageous to provide a core for a differential type sensing unit so that the sensing unit can be inexpensively and quickly manufactured. It also is desirable and advantageous to provide a differential type sensing unit which is small in size and has leads configured so that the sensing unit can be positioned close to a coin path in a coin detector.

An object of the present invention is to provide a differential type sensing unit which can be easily and quickly manufactured.

Another object of the present invention is to provide a relatively small differential type sensing unit suitable for use in vending machine applications.

Still another object of the present invention is to provide a differential type sensing unit in which all of the leads extend from one end of the sensing unit core so that the other end of the sensing unit can be positioned close to a coin path.

Yet another object of the present invention is to provide a differential type sensing unit in which all of the leads or wires from such unit terminate in a connector block so that the sensing unit can be easily installed and replaced in various coin detectors.

SUMMARY OF THE INVENTION

These and other objects of the invention are attained in an assembly which, in one embodiment, is an integrated differential type sensing and driving unit. The integrated unit includes a core on which two sensing coils and two driving coils are formed. The core includes a winding shaft having first and second ends. A post extends from the winding shaft and is located intermediate the first and second ends. A first shaft portion between the first shaft end and the post forms a first winding area. A second shaft portion between the second shaft end and the post forms a second winding area.

A first sensing coil is formed on the first winding area and a second sensing coil is formed on the second winding area. The second sensing coil is wound in the opposite direction of the first sensing coil to form a series opposing configuration. The core is configured to allow the winding direction to be reversed without requiring complex winding techniques or adhesives to hold the turns of the coils in place.

Particularly, a portion of the first sensing coil is formed starting at the winding shaft first end and winding a conductor around the first winding area towards the post. When the post is reached, the conductor is partially wrapped around the post so that the first sensing coil does not loosen or unwind. The winding direction of the conductor is reversed as the conductor enters the second winding area. A portion of the second sensing coil is then formed starting at the post and winding the conductor around the second winding area towards the winding shaft second end. Once the winding shaft second end is reached, the conductor is wound around the second winding area from the winding shaft second end back to the post. The conductor is again partially wrapped around the post so that the winding direction of the conductor is reversed as it enters the first winding area. The first sensing coil is completed as the conductor is wound around the first winding area from the post toward the winding shaft first end. The sensing coils formed on the first and second winding areas are in a series opposing configuration. Particularly, as compared to each other, the first sensing coil is wound in a direction opposite the direction in which the second sensing coil is wound.

The driving coils are formed over the sensing coils. Particularly, a first driving coil is formed in the first winding area over the first sensing coil. Similarly, a second driving coil is formed in the second winding area over the second sensing coil. The second driving coil is wound in the same direction as the first driving coil. That is, in a series adding configuration The driving coils are formed in a manner similar to the sensing coils except that the winding direction of the conductor forming the driving coils is not reversed at the core post when forming the driving coils.

In the integrated unit described above, all leads of the sensing and driving coils extend from the first end of the winding shaft and terminate in a connector block. The connector block allows for quick and reliable connection of the driving coil leads and sensing coil leads to other components. The connector block also facilitates removal or replacement of the integrated unit.

Integrating the sensing coils and driving coils on one core results in a compact and small unit which can be readily used in vending machine applications. The small size of the unit results in space savings in the vending machine. Also, since the sensing coils are formed without requiring the use of adhesives, the manufacturing cost associated with making the units is reduced. In addition, since the leads extend from the first end of the winding shaft, and since the integrated sensing and driving unit is small, the second end of the winding shaft can be placed close to the coin path for greater magnetic coupling between the coils and the coin passing along the coin path. As a result, a stronger signal is induced in the sensing coils and coin detection accuracy is improved.

DETAILED DESCRIPTION OF THE DRAWINGS

Figure 1:
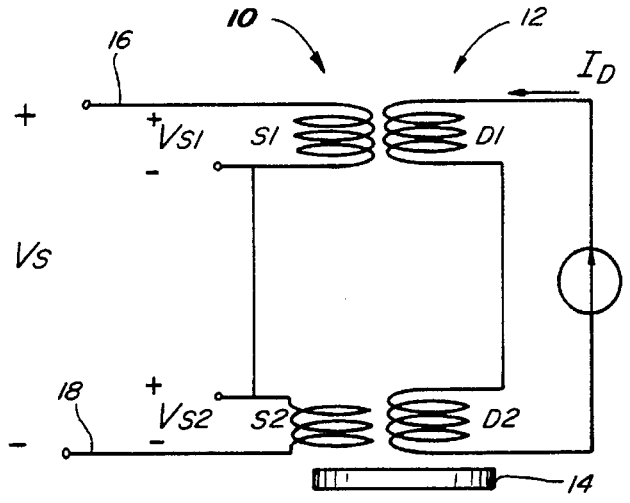
FIG. 1 is a schematic illustration of a differential type sensing unit and a driving unit.

FIG. 1 is a schematic illustration of a differential type sensing unit 10 and a driving unit 12. Differential type sensing unit 10 includes two sensing coils S1, S2 formed in a series opposing configuration. Driving unit 12 includes two driving coils D1, D2 formed in a series adding configuration. Sensing coils S1, S2 and driving coils D1, D2 are illustrated in connection with a coin 14. Each coil S1, S2 and D1, D2 is configured and positioned for magnetically coupling with coin 14.

In operation, coin 14 passes by an optical sensor (not shown) which is positioned along the coin path near driving unit 12. In particular, the optical sensor includes a light emitting diode positioned on one side of the coin path and a corresponding phototransistor positioned on the other side of the coin path and opposite the diode. Coin 14 passing along the coin path interrupts the light signal from the light emitting diode thereby de-energizing the phototransistor. When the phototransistor is de-energized an alternating current $I_D$ is supplied to driving unit 12. Alternating current $I_D$ energizes driving coils D1, D2 which generate a varying magnetic field. The varying magnetic field induces eddy currents in coin 14 as coin 14 cuts through such fields. The eddy currents induced in coin 14 generate magnetic fields. The varying magnetic field of driving coils D1, D2 and the magnetic fields associated with the eddy currents in coin 14 induce a voltage $V_{S1}$ in sensing coil S1 and induce a voltage $V_{S2}$ in sensing coil S2.

Voltages $V_{S1}$ and $V_{S2}$ are not identical since the coin is moving relative to sensing coils S1, S2 and because sensing coil S1 is positioned further from coin 14 than sensing coil S2. Under such conditions, the magnitude of voltage $V_{S2}$ is greater than the magnitude of voltage $V_{S1}$, $|V_{S2}|>|V_{S1}|$. Further, due to the series opposing configuration of sensing coils S1, S2 the polarity of voltage $V_{S1}$ is opposite the polarity of voltage $V_{S2}$. With respect to the effect of the magnetic fields of coin 14 only, a voltage $V_S$ measured across sensing leads 16 and 18 is equal to the sum of the voltages $V_{S1}$ and $V_{S2}$, or, due to the opposite polarities, the difference between the absolute values of $V_{S1}$ and $V_{S2}$.

Voltages $V_{S1}$ and $V_{S2}$, and similarly differential voltage $V_S$, vary depending on the resistance, inductance, and permeability of the coin material as well as coin thickness and diameter. In operation, by comparing signals $V_{S1}$, $V_{S2}$, and $V_S$ with predetermined unique signal characteristics for known coin types, the coin type of coin 14 can be determined.

Figure 2:
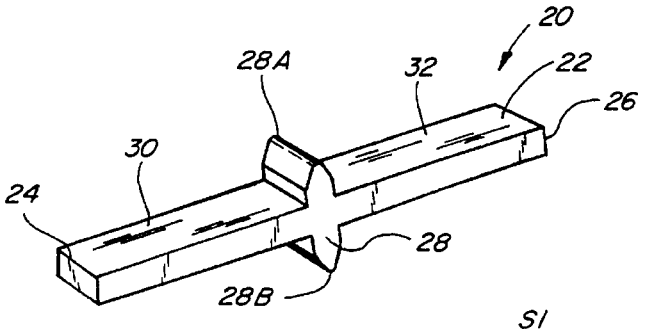
FIG. 2 is a perspective view of a core.

FIG. 2 illustrates a core 20 including a winding shaft 22 extending between first and second ends 24 and 26, respectively. A post 28 extends from winding shaft 22 and is located intermediate a first winding area 30 and a second winding area 32. Post 28 includes a first post portion 28A and a second post portion 28B. First post portion 28A extends from winding shaft 22 in a first direction. Second post portion 28B extends from winding shaft 22 in a second direction. Core 20 is formed from ferrite or some other conductive material such as compressed soft iron powder, laminates, or some other ferromagnetic material. The material utilized depends, in part, on the coin detector the core is incorporated in and on the magnitude and frequency of the driving signal used. With respect to post 28, the longitudinal length of post 28 is substantially less than the axial length of winding shaft 22 to reduce magnetic flux losses in post 28. Magnetic flux losses in post 28 may also be reduced by separately forming post 28 from a non-conductive material such as plastic. The separate post 28 would then be attached to winding shaft 22 using, for example, an adhesive.

Figure 3:
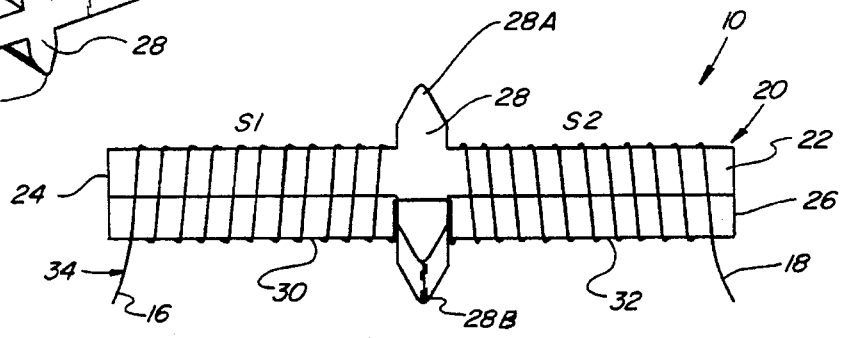
FIG. 3 is a perspective view of a differential type sensing unit.

An exemplary configuration of differential type sensing unit 10 is illustrated in FIG. 3. Sensing coils S1, S2 are formed on core 20 from an insulated conductor 34. Clockwise and counterclockwise directions are defined relative to a view looking into winding shaft second end 26 toward winding shaft first end 24. Sensing coil S1 is formed starting near winding shaft first end 24. Conductor 34 is wound clockwise around winding shaft 22 along first winding area 30, for $N_{S1}$ turns, until reaching post 28. Conductor 34 is then partially wrapped around second post portion 28B so that the winding direction of conductor 34 is reversed as it enters second winding area 32. Second sensing coil S2 is then formed as conductor 34 is wound counterclockwise around winding shaft 22 from post 28 along second winding area 32, for $N_{S2}$ turns, toward winding shaft second end 26. By wrapping conductor 34 around second post portion 28B, first sensing coil S1 does not loosen or unwind when the winding direction is reversed. Sensing lead 16 extends from winding shaft first end 24 and sensing lead 18 extends from winding shaft second end 26.

Figure 4:
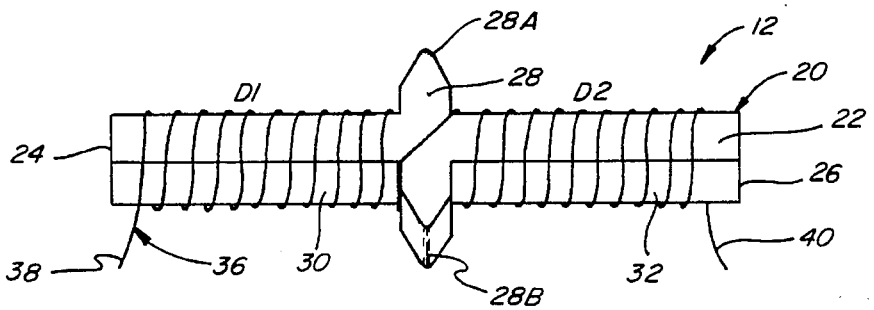
FIG. 4 is a perspective view of a driving unit.

FIG. 4 illustrates an exemplary configuration of driving unit 12. Driving coils D1, D2 are formed on core 20 from an insulated conductor 36. Clockwise and counterclockwise directions are defined relative to a view looking into winding shaft second end 26 toward winding shaft first end 24. Driving coil D1 is formed starting near winding shaft first end 24. Conductor 36 is wound clockwise around winding shaft 22 along first winding area 30, for $N_{D1}$ turns, until reaching post 28. Conductor 34 is then wrapped past post 28 into second winding area 32. Second driving coil D2 is then formed as conductor 36 is wound clockwise around winding shaft 22 along second winding area 32, for $N_{D2}$ turns, towards winding shaft second end 26. Driving lead 38 extends from winding shaft first end 24 and driving lead 40 extends from winding shaft second end 26.

Although coils S1, S2 and D1, D2, as illustrated in FIG. 3 and FIG. 4, are depicted in a loose winding scheme, the typical configuration for coils S1, S2, and D1, D2 is such that the turns of each coil are tightly wound around winding shaft 22. Similarly, each winding turn may be adjacent a preceding turn so that overall size of winding shaft 22 can be kept to a minimum. Further, the number of turns for each coil S1, S2 and D1, D2 may be selected depending on the particular application.

In vending machine applications, differential type sensing unit 10 illustrated in FIG. 3 and driving unit 12 illustrated in FIG. 4 may be positioned adjacent the coin path as schematically illustrated in FIG. 1. In operation, as coin 12 passes by driving unit 12, driving coils D1, D2 are energized with a known signal. As described in detail with reference to FIG. 1, signals induced in sensing coils S1, S2 are analyzed to determine coin type.

Figure 5:
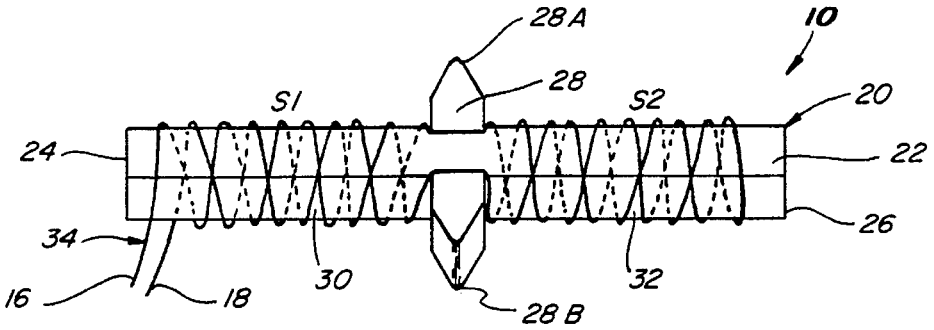
FIG. 5 is a perspective view of an alternative sensing coil configuration for the differential type sensing unit.

FIG. 5 illustrates an alternative coil configuration for differential type sensing unit 10. Clockwise and counterclockwise directions are defined relative to a view looking into winding shaft second end 26 toward winding shaft first end 24. Sensing coil S1 is formed starting near winding shaft first end 24. Conductor 34 is wound clockwise around winding shaft 22 along first winding area 30, for $N_{S1A}$ turns, until reaching post 28. Conductor 34 is then partially wrapped around second post portion 28B so that the winding direction is reversed. Second sensing coil S2 is then formed as conductor 34 is wound counterclockwise around winding shaft 22 from post 28 along second winding area 32, for $N_{S2A}$ turns, toward winding shaft second end 26. Winding of sensing coil S2 then continues as conductor 34 is wound counterclockwise around winding shaft 22, from winding shaft second end 26 back along second winding area 32, over the previously wrapped conductor 34, for $N_{S2B}$ turns, until reaching post member 28. Conductor 34 is partially wrapped around first post portion 28A so that the winding direction is again reversed. Winding of sensing coil S1 begins again as conductor 34 is wound clockwise around winding shaft 22, from post member 28 along first winding area 30, over the previously wrapped conductor 34, for $N_{S1B}$ turns, toward winding shaft first end 24. Sensing leads 16 and 18 both extend from winding shaft first end 24.

FIG. 3 and FIG. 5 illustrate alternative configurations for differential sensing unit 10. In the configuration illustrated in FIG. 3, sensing coil S1 is formed by one set of turns having $N_{S1}$ turns. In the configuration illustrated in FIG. 5, sensing coil S1 is formed by two sets of turns, one set having $N_{S1A}$ turns and the other set having $N_{S1B}$ turns. Sensing coil S1 of FIG. 3 and sensing coil S1 of FIG. 5 have similar sensing properties if the relationship between the number of turns is such that $N_{S1}=N_{S1A}+N_{S1B}$, and the turns are similarly distributed over the same length of winding shaft 22. Similarly, for sensing coil S2, the two configurations have similar properties if $N_{S2}=N_{S2A}+N_{S2B}$, and the turns are similarly distributed over the same length of winding shaft 22.

Figure 6:
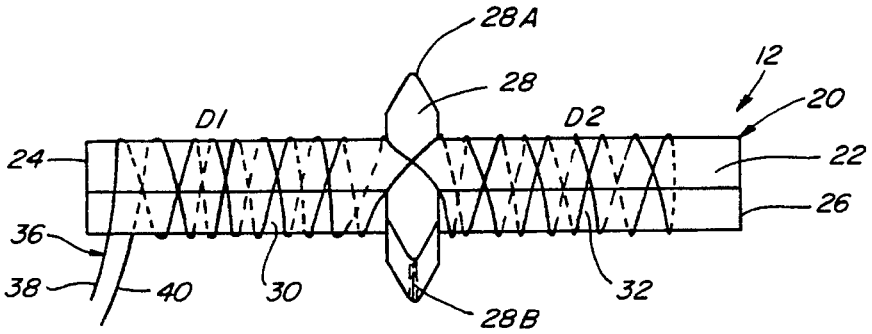
FIG. 6 is a perspective view of an alternative driving coil configuration for the driving unit.

FIG. 6 illustrates an alternative coil configuration for driving unit 12. Clockwise and counterclockwise directions are defined relative to a view looking into winding shaft second end 26 toward winding shaft first end 24. Driving coil D1 is formed starting near winding shaft first end 24. Conductor 36 is wound clockwise around winding shaft 22 along first winding area 30, for $N_{D1A}$ turns, until reaching post 28. Conductor 36 is then wrapped past post 28 into second winding area 32 and second driving coil D2 is wound clockwise around winding shaft 22 along second winding area 32, for $N_{D2A}$ turns, toward winding shaft second end 26. Winding of driving coil D2 continues clockwise around winding shaft 22 from winding shaft second end 26, back over the previously wrapped conductor 36, for $N_{D2B}$ turns, until reaching post 28. Conductor 36 is again wrapped past post 28 and winding of driving coil D1 begins again, clockwise around winding shaft 22, from post 28, over the previously wrapped conductor 36, for $N_{D1B}$ turns, toward winding shaft first end 24. Driving leads 38 and 40 extend from winding shaft first end 24.

As described above with respect to the alternative configurations of differential type sensing unit 10, the alternative configurations for driving unit 12 as illustrated in FIG. 4 and FIG. 6 may be related to achieve similar properties if the number of turns is such that for driving coil D1, $N_{D1}=N_{D1A}+N_{D1B}$, and for driving coil D2, $N_{D2}=N_{D2A}+N_{D2B}$, and the turns are similarly distributed over the same length of winding shaft 22.

The operation of differential type sensing unit 10 illustrated in FIG. 5 and driving unit 12 illustrated in FIG. 6 is identical to the operation of differential type sensing unit 10 illustrated in FIG. 3 and driving unit 12 illustrated in FIG. 4. Differential type sensing unit 10 and driving unit 12 also would be positioned as illustrated in FIG. 1.

Figure 7:
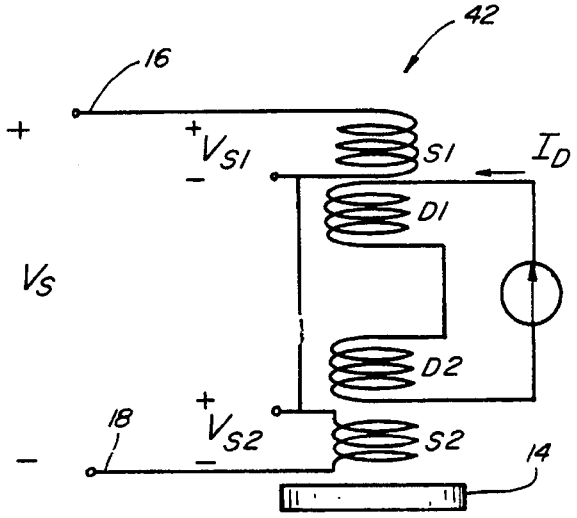
FIG. 7 is a schematic illustration of an integrated differential type sensing and driving unit.

As explained above, although sensing coils S1, S2 and driving coils D1, D2 may form separate sensing unit 10 and separate driving unit 12, both sensing coils S1, S2 and driving coils D1, D2 may be formed on one core 20 to form an integrated sensing and driving unit 42. A schematic illustration of an integrated sensing and driving unit 42 is illustrated in FIG. 7. Driving coils D1, D2 are formed over the top of sensing coils S1, S2. However, for ease of understanding, driving coils D1, D2 are illustrated between sensing coils S1, S2. Such an integrated sensing and driving unit 42 is particularly suitable for applications, such as vending machine applications, where space is limited. In vending machine applications, core 20 of an integrated sensing and driving unit 42 is positioned adjacent the coin path for magnetically coupling with coin 14 traveling along the coin path. The operation of the integrated sensing and driving unit 42 is identical to that of the separate sensing unit 10 and separate driving unit 12 illustrated in FIG. 1.

Figure 8:
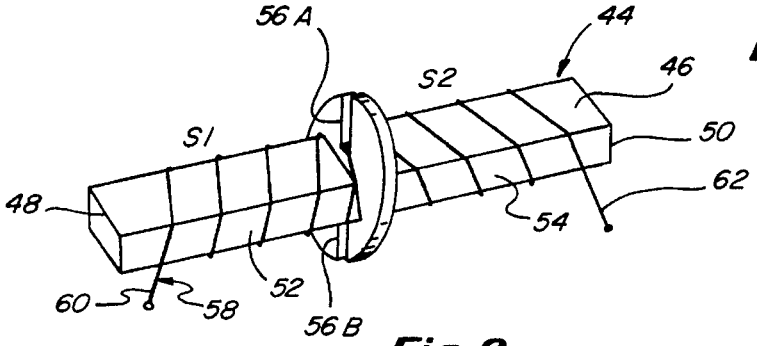
FIG. 8 is a perspective view of an alternative embodiment of a core.

Other configurations of core 20 are, of course, possible. For example, an alternative core 44 is illustrated in FIG. 8. Core 44 includes a winding shalt 46 extending between first and second ends 48 and 50, respectively. Winding shaft 46 includes a first winding area 52, a second winding area 54, and a ring member 56 located intermediate first winding area 52 and second winding area 54. Two slots, 56A and 56B, are formed in ring member 56 and extend toward winding shaft 46. Similar to post portions 28A and 28B of FIG. 2, slots 56A and 56B allow the winding direction to be reversed during the forming of sensing coils S1, S2. A conductor 58 wound in first winding area 52 passes through slot 56A allowing conductor 58 to be wound in the opposite direction in second winding area 54 as shown. Although this configuration illustrates lead 60 extending from first end 48 and lead 62 extending from second end 50, it is understood that the coil configurations of FIG. 5 and FIG. 6 can be incorporated with core 44 such that all leads extend from first end 48. Similarly, core 44 could be used to form an integrated sensing and driving unit 42.

Figure 9:
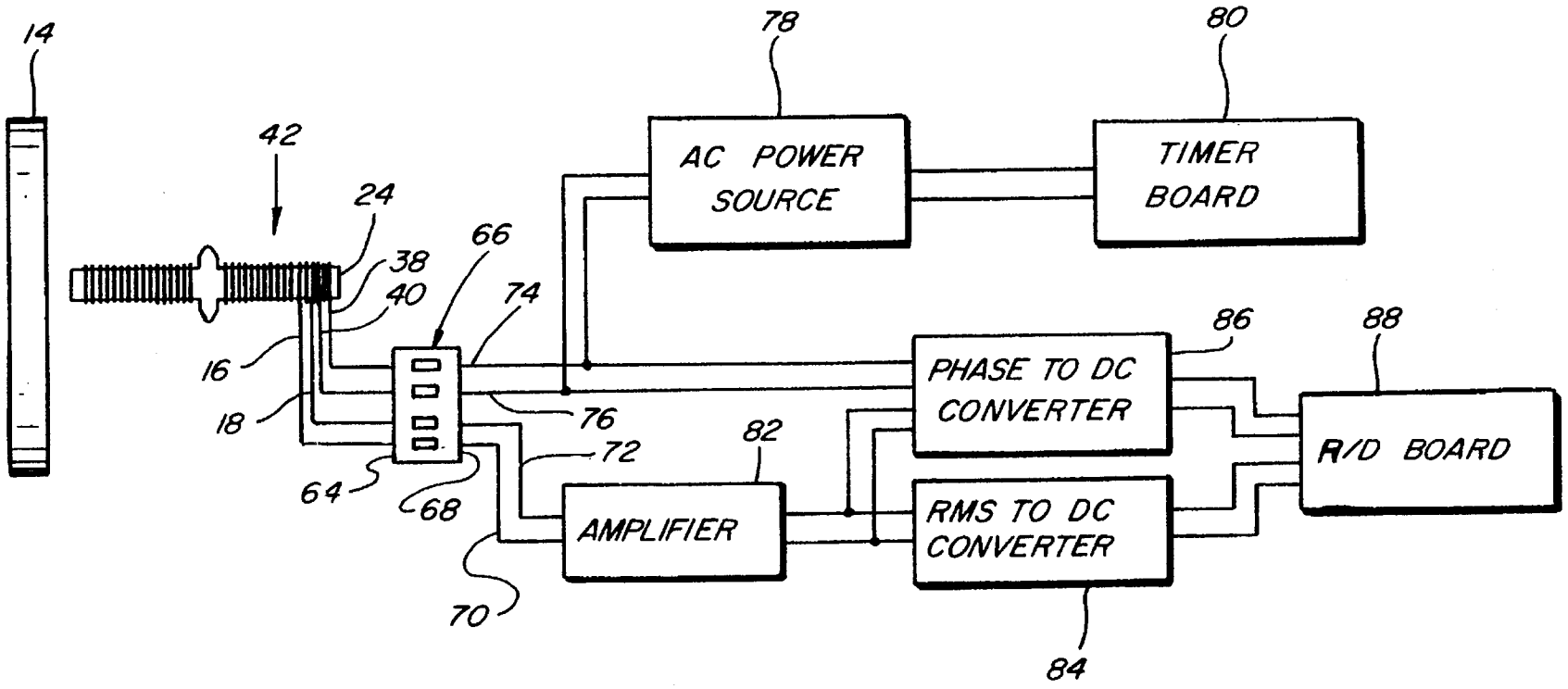
FIG. 9 is a block diagram illustration of a coin detector.

FIG. 9 is a block diagram illustration of a coin detector. Integrated sensing and driving unit 42 is positioned alongside coin 14. Leads 16, 18, 38, and 40 extend from winding shaft first end 24, each lead terminating at a first side 64 of a connector block 66. Removably attachable to a second side 68 of connector block 66 are conductors 70, 72, 74, and 76. Each conductor 70, 72, 74, and 76 is electrically connected to corresponding leads 16, 18, 38, and 40, respectively, by connector block 66. Each conductor 70, 72, 74, and 76 extends from connector block 66 to other coin detector circuit components. Particularly, conductors 74 and 76, connected to driving leads 38 and 40, respectively, are connected to an AC power source 78. A timer board 80 is connected to power source 78. Timer board 80 receives control signals from the optical sensor (not shown) positioned along the coin path as hereinbefore described. Conductors 70 and 72, connected to sensing leads 16 and 18, respectively, are connected to an amplifier 82. Amplifier 82 is connected to an RMS to DC converter 84 and to a phase to DC converter 86. AC power source 78 also is connected to phase to DC converter 86. Converters 84 and 86 are connected to an analog to digital converter board 88.

Terminating leads 16, 18, 38, and 40 in connector block 66 facilitates quick and reliable connection of leads 16, 18, 38, and 40 to other coin detector circuit components. Removal or replacement of integrated unit 42 is also facilitated by the use of connector block 66. Accordingly, repair time and costs associated with devices incorporating the integrated unit are reduced.

From the preceding description of the illustrated embodiments, it is evident that the objects of the invention are attained. In particular, cores 20, 44 greatly simplify formation of sensing coils S1, S2 by enabling the sensing coil winding direction to be easily reversed without the use of adhesives. Further, cores 20, 44 also facilitate manufacture of small differential type sensing units and integrated sensing and driving units. In addition, differential type sensing units, driving units, and integrated sensing and driving units can be formed such that all leads extend from one end of the unit and terminate in connector block. Such a construction enables positioning at least a portion of the units close to a coin path and easy installation and replacement of the units in various coin detectors and validators.

Although the invention has been described and illustrated in detail, it is to be clearly understood that the same is intended by way of illustration and example only and is not to be taken by way of limitation. For example, alternative core configurations which enable the sensing coil winding direction to be reversed are possible. Further, the material from which the core is formed can be any material having suitable magnetic field carrying characteristics, depending upon the size of the unit as well as the frequency and amplitude of the driving signal. In addition, the cross-sectional shape, looking from end to end, of winding shafts 22, 46 could also vary from the illustrated rectangular shape. For example, winding shafts 22, 46 could be cicular in cross-sectional shape, or could have any other cross-sectional shape. Further, only one post portion 28A or 28B could be used. It is also contemplated that post 28 and ring member 56 could be formed from a non-conductive material and separate from winding shaft 22, 46 and then attached to winding shaft 22, 46. It is also possible that the number of turns making up the various coils of differential type sensing unit 10, driving unit 12, or integrated sensing and driving unit 42 could vary considerably. Accordingly, the spirit and scope of the invention are to be limited only by the terms of the appended claims.

What is claimed is:

1. A core configured for constructing a coin detection apparatus, the coin detection apparatus including at least a first coil and a second coil formed on said core, the first and second coils to be formed from one conductor, said core comprising:

a winding shaft including first and second ends and having a first winding area and a second winding area;

means for facilitating reversing the winding direction of the one conductor, said means extending from said winding shaft at a location intermediate said first and second ends, wherein said means for facilitating reversing the winding direction of the one conductor comprises a post having a length which is substantially less than an axial length of said winding shaft so as to reduce flux losses therethrough;

wherein said first winding area extends from adjacent said first end of said winding shaft to said intermediate location and said second winding area extends from adjacent said second end of said winding shaft to said intermediate location.

2. A core in accordance with claim 1 wherein said post comprises a first post portion extending from said winding shaft in a first direction.

3. A core in accordance with claim 2 wherein said post further comprises a second post portion extending from said winding shaft in a second direction.

4. A core in accordance with claim 1 wherein said core is constructed of a ferrite material.

5. A core in accordance with claim 1 wherein said core is constructed of a soft iron powder material.

6. A core in accordance with claim 1 wherein said core is constructed of a plurality of laminates.

7. A core in accordance with claim 1 wherein said core is constructed of a ferromagnetic material.

8. A core in accordance with claim 1 wherein said winding shaft has a rectangular cross-sectional shape.

9. A core in accordance with claim 1 wherein said means for reversing the winding direction of the conductor is integral with said winding shaft.

10. A core in accordance with claim 1 wherein said post is formed separately from said winding shaft and attached to said winding shaft at said intermediate location.

11. A core in accordance with claim 10 wherein said separately formed post member is formed from a nonconductive material.

12. An integrated sensing and driving unit, comprising:

a core including a winding shaft having a first end, a second end, a first winding area and a second winding area;

a post positioned at a location intermediate said first winding area and said second winding area;

a first conductor wound around said winding shaft to form a first sensing coil in said first winding area and a second sensing coil in said second winding area, said first conductor partially wrapped around said post, said first sensing coil and said second sensing coil formed in a series opposing configuration;

a second conductor wound around said winding shaft, said second conductor forming a first driving coil in said first winding area and a second driving coil in said second winding area, said first driving coil and said second driving coil formed in a series adding configuration, wherein said first winding area extends from adjacent said first end of said winding shaft to said intermediate location and said second winding area extends from adjacent said second end of said winding shaft to said intermediate location, and said post has a length which is substantially less than an axial length of said winding shaft so as to reduce flux losses therethrough.

13. An integrated sensing and driving unit in accordance with claim 12 wherein said first driving coil is formed over the top of said first sensing coil.

14. An integrated sensing and driving unit in accordance with claim 13 wherein said second driving coil is formed over the top of said second sensing coil.

15. An integrated sensing and driving unit in accordance with claim 12 wherein said first conductor includes a first sensing lead and a second sensing lead, said second conductor includes a first driving lead and a second driving lead, said first sensing lead, second sensing lead, first driving lead, and second driving lead all extending from said first end of said winding shaft.

16. An integrated sensing and driving unit in accordance with claim 15 further comprising:

a connector block, said first sensing lead, second sensing lead, first driving lead, and second driving lead all terminating at said connector block.

17. A device for detecting a coin, comprising:

a coin path along which the coin travels;

a core including a winding shaft having a first end, a second end, a first winding area, and a second winding area, said core further including a post extending from said winding shaft and located intermediate said first and second winding areas, one end of said core being positioned adjacent said coin path, a first conductor wound around said winding shaft in a first direction to form a first sensing coil in said first winding area and wound around said winding shaft in an opposite direction to form a second sensing coil in said second winding area, a first portion of said first conductor being partially wrapped around said post in order to reverse the winding direction as between said first sensing coil and said second sensing coil so that said first sensing coil and said second sensing coil are formed in a series opposing configuration, wherein said first conductor includes a first sensing lead and a second sensing lead, a second portion of said first conductor being partially wrapped around said post so that said first sensing coil is formed from a first and second set of turns, said first set of turns formed by a portion of said first conductor located intermediate said first sensing lead and said second sensing coil, and said second set of turns formed by a portion of said first conductor located intermediate said second sensing coil and said second sensing lead, whereby said first sensing lead and said second sensing lead extend from said first end of said winding shaft.

18. A device in accordance with claim 17 further comprising means for producing an eddy current within the coin as it passes by the core, wherein said second end of said winding shaft is located adjacent said coin path such that an electromagnetic field associated with said coin eddy current induces a voltage in each of said first and second sensing coils.

19. A device in accordance with claim 18 wherein said post comprises a first post portion extending from said winding shaft in a first direction.

20. A device in accordance with claim 19 wherein said post further comprises a second post portion extending from said winding shaft in a second direction and a length of said post is substantially less than an axial length of said winding shaft so as to reduce flux losses therethrough.

21. A device in accordance with claim 17, further comprising:

a second conductor wound around said winding shaft to form a first driving coil in said first winding area and a second driving coil in said second winding area, where said first and second driving coils are formed in a series adding configuration, said first winding area extending from said winding shaft first end to said post and said second winding area extending from said winding shaft second end to said post.

22. A device in accordance with claim 21 wherein said first driving coil is formed over the top of said first sensing coil.

23. A device in accordance with claim 22 wherein said second driving coil is formed over the top of said second sensing coil.

24. A device in accordance with claim 21 wherein said second conductor includes a first driving lead and a second driving lead, said first driving coil is formed from a first and second set of turns, said first set of turns formed by a portion of said second conductor located intermediate said first driving lead and said second driving coil, and said second set of turns formed by a portion of said second conductor located intermediate said second driving coil and said second driving lead, whereby said first driving lead and said second driving lead extend from said first end of said winding shaft.

25. A device in accordance with claim 24, further comprising:

a connector block, said first driving lead, second driving lead, first sensing lead, and second sensing lead all terminating at said connector block.

26. A device in accordance with claim 24 further comprising an AC power source, said first driving lead and said second driving lead being connected to said AC power source, whereby, a current running through said second conductor results in an electromagnetic field which cuts across said coin path so that an eddy current is induced in a coin traveling along said coin path in the region of said electromagnetic field.

27. A device in accordance with claim 26 further comprising an amplifier, said first sensing lead and said second sensing lead being connected to said amplifier, whereby, an electromagnetic field produced by said coin eddy current contributes to the production of a signal across said first and second sensing leads, and a magnitude of said signal is increased by said amplifier.

28. A method of forming a first coil and a second coil in a series opposing configuration from a conductor on a core having a winding shaft including a first axial end, a second axial end, a first winding area, a second winding area, a post extending from the winding shaft and positioned at a location intermediate the first and second axial ends, the first winding area extending from adjacent the first axial end of the winding shaft to the intermediate location and the second winding area extending from adjacent the second axial end of the winding shaft to the intermediate location, said method comprising the steps of:

beginning at the winding shaft first axial end and winding the conductor in a first direction around the first winding area and toward the post;

partially wrapping the conductor around the post; and beginning at the post and winding the conductor in a second direction around the second winding area toward the winding shaft second axial end.

29. A method of forming a first coil and a second coil in a series opposing configuration from a conductor on a core having a winding shaft including a first winding area and a second winding area, a post extending from said winding shaft and located intermediate the first and second winding areas, said method comprising the steps of:

winding the conductor in a first direction around the first winding area forming a first plurality of turns;

partially wrapping the conductor around the post;

winding the conductor in a second direction around the second winding area forming a second plurality of turns;

partially wrapping the conductor around the post; and winding the conductor in the first direction around the first winding area forming a third plurality of turns.

30. An integrated sensing and driving unit, comprising:

a core including a winding shaft having a first end, a second end, a first winding area and a second winding area;

a post located intermediate said first winding area and said second winding area;

a first conductor wound around said winding shaft to form a first sensing coil in said first winding area and a second sensing coil in said second winding area, said first conductor partially wrapped around said post, said first sensing coil and said second sensing coil formed in a series opposing configuration, said first conductor further including a first sensing lead and a second sensing lead; and a second conductor wound around said winding shaft, said second conductor forming a first driving coil in said first winding area and a second driving coil in said second winding area, said first driving coil and said second driving coil formed in a series adding configuration, said second conductor further including a first driving lead and a second driving lead, wherein said first sensing lead, second sensing lead, first driving lead, and second driving lead all extend from said first end of said winding shaft.

31. An integrated sensing and driving unit in accordance with claim 30 further comprising:

a connector block, said first sensing lead, second sensing lead, first driving lead, and second driving lead all terminating at said connector block.

32. A core configured for constructing a coin detection apparatus, the coin detection apparatus including at least a first coil and a second coil formed on said core, the first and second coils to be formed from one conductor, said core comprising:

a winding shaft including first and second ends and having a first winding area and a second winding area;

means for facilitating reversing the winding direction of the one conductor, said means extending from said winding shaft at a location intermediate said first and second ends, wherein said means for reversing the winding direction of the conductor includes at least one post member formed separately from said winding shaft and attached to said winding shaft at said intermediate location;

wherein said first winding area extends from adjacent said first end of said winding shaft to said intermediate location and said second winding area extends from adjacent said second end of said winding shaft to said intermediate location.

33. A core in accordance with claim 32 wherein said separately formed post member is formed of a nonconductive material.

* * * * *